US005791815A

United States Patent [19]

Rowe

[11] Patent Number: 5,791,815

[45] Date of Patent: Aug. 11, 1998

[54] VIBRATING COMPACTOR ASSEMBLY FOR USE WITH A CONCRETE FINISHING MACHINE

[75] Inventor: Murray A. Rowe, Canton, S. Dak.

[73] Assignee: CMI Corporation, Oklahoma City, Okla.

[21] Appl. No.: 667,236

[22] Filed: Jun. 21, 1996

[51] Int. Cl.[6] ..... E01C 19/28

[52] U.S. Cl. ..... 404/103; 404/117; 404/124; 404/128

[58] Field of Search ..... 404/102, 103, 404/115, 117, 120, 122, 124, 128

[56] References Cited

U.S. PATENT DOCUMENTS

| | | |
|---|---|---|
| 1,623,142 | 4/1927 | Walsh . |
| 2,728,277 | 12/1955 | McRae . |
| 3,176,597 | 4/1965 | Seaman . |
| 3,253,522 | 5/1966 | Piper . |
| 3,283,678 | 11/1966 | Domenighetti . |
| 3,528,348 | 9/1970 | Rowe et al. . |
| 3,703,128 | 11/1972 | Fransson . |
| 3,738,763 | 6/1973 | Glesmann . |
| 3,753,621 | 8/1973 | Dale . |
| 3,850,541 | 11/1974 | Baillet et al. . |
| 3,870,427 | 3/1975 | Allen . |
| 4,068,970 | 1/1978 | Rowe . |
| 4,256,415 | 3/1981 | Rowe et al. . |
| 4,320,987 | 3/1982 | Rowe et al. . |
| 4,323,321 | 4/1982 | Dale . |
| 4,702,644 | 10/1987 | Cioffi . |
| 4,708,520 | 11/1987 | Rowe . |
| 4,775,262 | 10/1988 | Guntharp et al. . |

FOREIGN PATENT DOCUMENTS

| | | | |
|---|---|---|---|
| 2349180 | 4/1975 | Germany . | |
| 509637 | 1/1955 | Italy | 404/124 |
| 699077 | 11/1979 | U.S.S.R. . | |

*Primary Examiner*—James Lisehora
*Attorney, Agent, or Firm*—Emrich & Dithmar

[57] ABSTRACT

A concrete finishing machine includes a surfacing unit having two finishing cylinders and two augers mounted in line with the two cylinders, a pair of compacting rollers located on either side of the augers and suspended by a frame which is attached to the surfacing unit by a mounting assembly which allows adjustment in the vertical height of the compacting rollers relative to the surfacing unit for setting the compacting rollers relative to the surface being finished. The frame is adapted to be vibrated for vibrating the compacting rollers in use. The compacting rollers each have an outer peripheral planar surface extending about the periphery of the roller and a plurality of recessed planar surfaces spaced equally about the periphery of the roller.

9 Claims, 3 Drawing Sheets

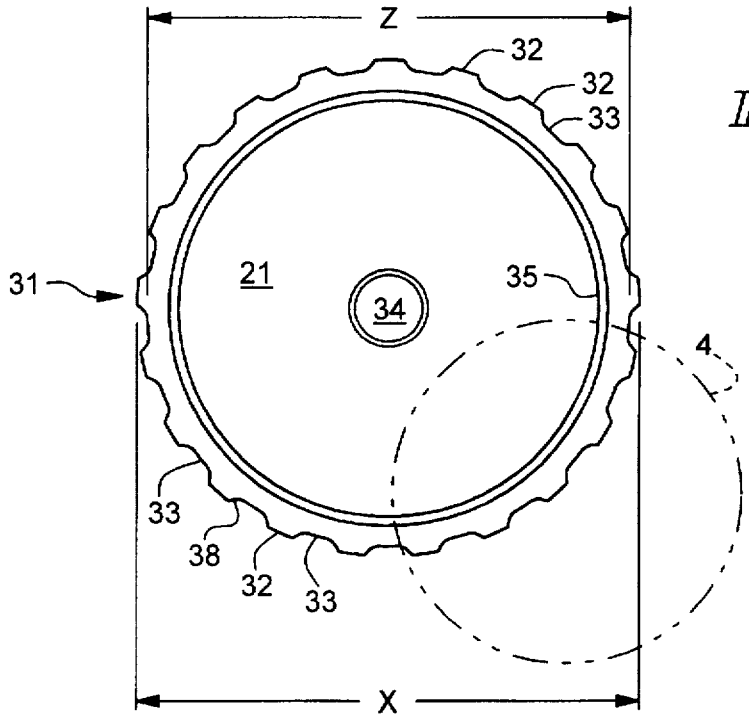
FIG. 5
FIG. 6
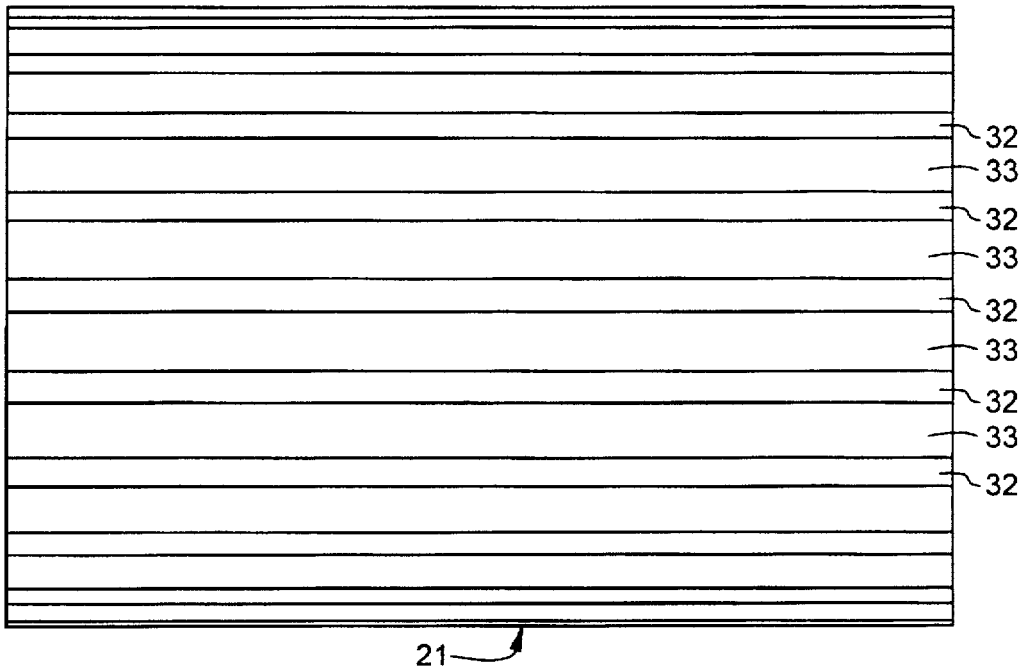

VIBRATING COMPACTOR ASSEMBLY FOR USE WITH A CONCRETE FINISHING MACHINE

BACKGROUND OF THE INVENTION

Invention relates to concrete finishing machines, and more particularly, to a novel vibrating compactor assembly for use with such concrete finishing machines.

Concrete vibrator apparatus for use in vibrating concrete ahead of a concrete finishing unit on highways, and the like, is will known in the art. Various types of concrete vibrating apparatus are known including concrete vibrator apparatus wherein the vibrators are moved into and out of concrete to be vibrated in a substantially vertical or rearwardly extending direction and moved forwardly along, or laterally across a highway or the like, in a step-like movement. Other concrete vibrator apparatus include vibrators which are dragged forwardly along the highway, or the like, ahead of the concrete finishing units. Another concrete vibrator apparatus, disclosed in U.S. Pat. No. 4,320,987 of Murray A. Rowe, et al., includes a vibrator unit movable back and forth transversely over the roadway, with the vibrator mechanism disposed in the concrete to be vibrated and being raisable and lowerable relative to the concrete to be vibrated. The vibrator mechanism is in the form of generally L-shaped members suspended on a support frame and actuated as by an hydraulic motor or the like.

A still further arrangement for a concrete vibrating apparatus incorporated into a concrete finishing machine is disclosed in U.S. Pat. No. 4,775,262. In U.S. Pat. No. 4,775,262, issued to Robert L. Guntharp and Murray A. Rowe and assigned to the assignee of the present invention, the finishing apparatus includes a compactor assembly having a pair of compacting rollers including projections thereof. The compactor assembly is vibrated to vibrate the concrete through the projections to obtain the proper density and concrete finish during finishing.

Although these known concrete vibrator apparatus improve the quality of the concrete surface finish, these finishing processes generally require the use of water in leveling of the concrete, resulting in dilution of the concrete and in failing to overcome wind exposure to which causes abnormal concrete surface drying.

SUMMARY OF THE INVENTION

It is one object of the present invention to provide an improved concrete compactor assembly for use with concrete finishing machines.

It is another object of the present invention to provide a vibrating concrete compactor assembly for use with concrete finishing machine which provides a finished uniform concrete surface.

It is still another object of the present invention is to provide a concrete compactor assembly having a novel surface configuration for providing optimum density of the concrete surface to obtain a high quality finish.

It is yet another object of the present invention to provide a novel compacting roller configuration having an outer peripheral smooth planar surface with equally spaced recesses about the periphery of the compacting roller to provide offset parallel arc surfaces.

These and other objects of the present invention are achieved by the instant invention which includes a concrete finishing machine of the type embodying an elongated main frame adapted for movement longitudinally along the roadway or deck surfaced. A surfacing unit is provided for finishing the concrete surface, with the surfacing unit being adapted for movement back and forth along the main frame laterally of the roadway. The surfacing unit includes a finishing cylinder means rotatably mounted to the main frame and a compacting means or assembly which is comprised of a sub-frame, compacting rollers, vibrating means, and mounting means.

The sub-frame rotatably mounts the compacting rollers of the compacting assembly in a parallel spaced relation. The compacting rollers each comprise an elongated cylinder having an outer peripheral smooth planar surfaces about the circumference of the cylinder with equally spaced recesses about the circumference of the cylinder to provide offset parallel arc surfaces on the cylinder. A vibrating means is coupled to the sub-frame for vibrating the sub-frame and the compacting rollers supported thereby. A mounting means is provided for mounting the sub-frame to the main frame of the concrete finishing machine. Also, isolating means is interposed between the suspension means and the sub-frame for preventing the transmission of vibrations from the sub-frame to the main frame as the sub-frame is vibrated. The operation and structure of the finishing machine, surfacing unit, finishing cylinder means and compacting means or assembly is described in our U.S. Pat. No. 4,775,262.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the present invention, there is illustrated in the accompanying drawings a preferred embodiment thereof, from an inspection of which, when considered in connection with the following description, the invention, its construction and operation, and many of its advantages will be readily understood and appreciated.

FIG. 5 is an end elevational view of a compacting roller in accordance with the present invention; and FIG. 6 is a side elevational view of the compactor roller, as shown in FIG. 5.

DESCRIPTION OF THE PREFERRED EMBODIMENTS

Figure 1:
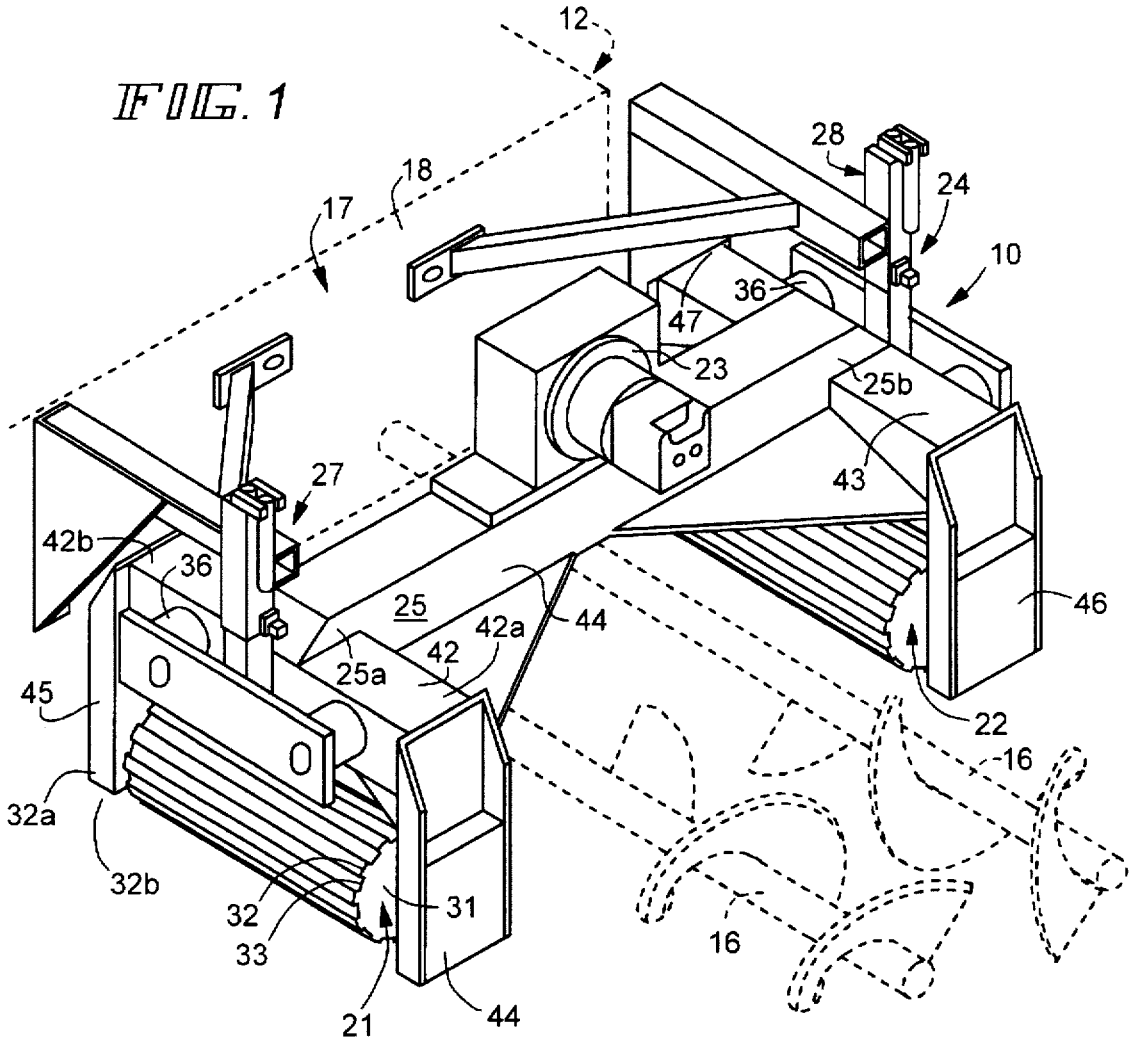
FIG. 1 is a perspective view of the vibrating compactor assembly provided in accordance with the present invention for use with a concrete finishing machine.
Figure 2:
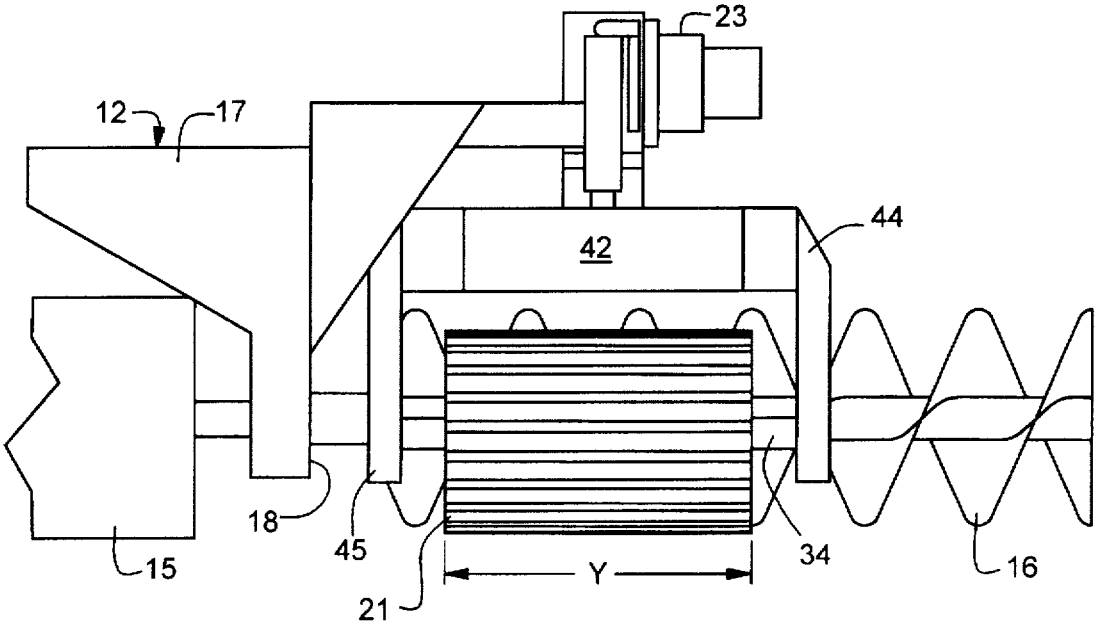
FIG. 2 is a side elevational view of the vibrating compactor assembly shown in FIG. 1.
Figure 3:
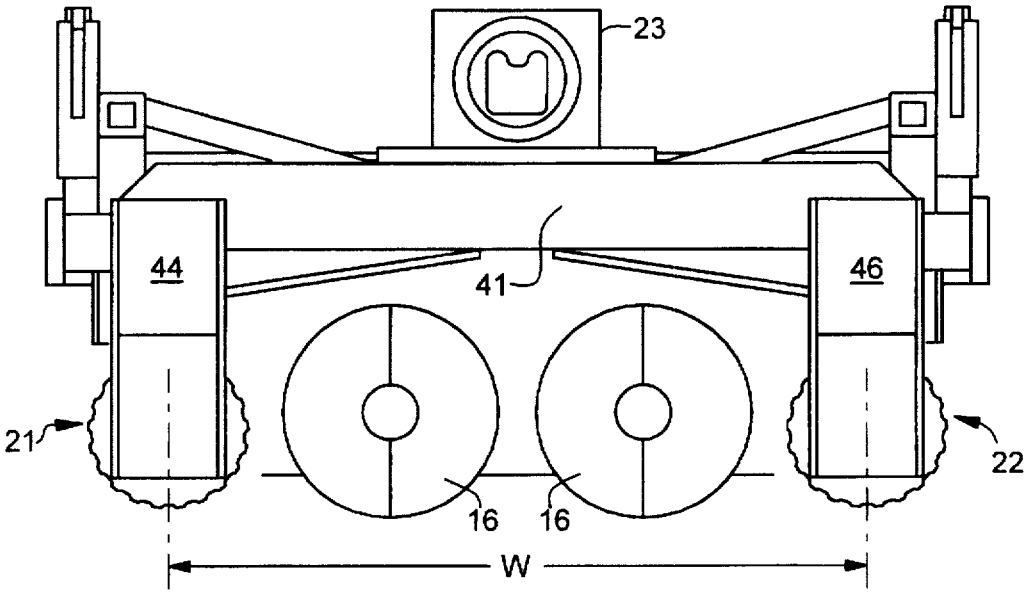
FIG. 3 is a front elevational view of the vibrating compactor assembly.

Referring now to the drawings wherein like numerals have been used throughout the several views to designate the same or similar parts, in FIGS. 1–3 the vibrating compactor assembly 10 provided by the present invention is shown mounted to a roller finisher apparatus or surfacing unit of a concrete finishing machine (not shown), only a portion of the surfacing unit being shown and indicated by reference numeral 12 (FIGS. 1 and 2). The concrete finishing machine is of the type embodying an elongated main frame (not shown) adapted for movement longitudinally along the roadway or deck being surfaced, carrying with it the surfacing unit 12 which is adapted for movement back and forth along the main frame laterally of the roadway or deck.

The roller surfacing unit 12 includes a pair of finishing rollers 15, only one of which is shown in FIG. 2, a pair of augers 16 (FIGS. 1 and 2), and a suitable support frame 17 including a forward panel 18. The augers 16 are disposed forwardly of the front of respective cylinders 15 and aligned axially thereof in substantially horizontal, uniplanar spaced relation to draw concrete toward the space between the augers as well as longitudinally outwardly along the augers, away from the finishing cylinders to turn the concrete to a grade prior to finishing by the roller surfacing unit, as is known in the art. Examples of a concrete finishing machines with dual augers are disclosed in Rowe et al., U.S. Pat. No. 3,528,348, entitled CONCRETE FINISHING MACHINES, and Rowe et al., U.S. Pat. No. 4,775,262, entitled CONCRETE FINISHING MACHINE WITH VIBRATING COMPACTOR UNIT, both patents which are assigned to the assignee of the present application. The manner in which the concrete roller finisher apparatus operates is known in the art and is described in the referenced patents and, accordingly, will only be generally described in the present application.

With reference to FIGS. 1–3, the vibrating compactor assembly 10 provided by the present invention includes a pair of compacting rollers 21 and 22, a vibrating apparatus or means 23, a sub-frame or means 24 including a compacting roller support frame member or means 25 to support the compacting rollers 21 and 22, and a pair of adjustable sub-assembly means 27 and 28 which attach the support frame 24 to the roller surfacing unit 12.

Each of the compacting rollers 21 and 22 includes a hollow elongated cylindrical member or drum 31 having an outer peripheral smooth planar surface 32 extending the axial length of the cylindrical member 31. Spaced equally about the circumference of the cylinder are a plurality of recesses each having an inner planar surface 33. The two offset substantially flat planar surfaces 32 and 33 on the outer peripheral surface of the drum substantially provide offset parallel arcs with respect to one another to effect the entire flat surface plane of the concrete surface. The outer peripheral surface 32 provides the surface that engages the concrete surface to be finished. In the disclosed embodiment, the parallel arc surfaces 32 and 33 extend the axial length of the cylindrical member or drum 31. However, the surfaces could be segmented along the axial length of the cylindrical member 31.

Figure 4:
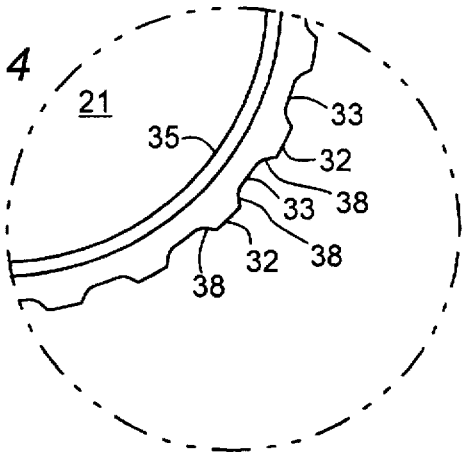
FIG. 4 is an enlarged view of the portion of the cylinder's outer surfaces of shown by the dotted circle of FIG. 5, illustrating the outer peripheral smooth planar surface with equally spaced recesses about the circumference of the compacting roller to provide offset parallel arc surfaces.

The cylindrical member or drum 31 is a hollow cylinder of light weight steel or aluminum. Each cylindrical member 31 is closed at each end by end plates 35, as shown in FIGS. 4 and 5. The end plates support an axle 34 extending axially of the cylindrical member and projecting outwardly at opposite ends thereof to facilitate rotatable mounting of the compacting roller to the support frame.

In one compactor assembly that has been constructed, the elongated cylindrical member 31 has an outer diameter "x" (FIG. 5) of 6¼" and a length "y" (FIG. 2) of 11½". The compacting roller has twenty-one inner equally spaced recesses about the circumference of the cylinder member to provide offset parallel arc surfaces between about ½ to 1" in width. The diameter "z" (FIG. 5) of the compacting roller 21 measured between the inner recessed planar surfaces is 6". Thus, the inner recessed planar surfaces 33 are spaced inwardly from the outer radial surface about ⅛", with the connection or bridge 38 (FIG. 4) between the inner and outer planar surfaces being sloped to ease the transition between the offset planar surfaces.

Each of the compacting cylinders or drums 21 and 22 has an outer peripheral surface diameter of 6¼", with the plurality of equally spaced arcuate shaped recesses extending inwardly from this outer peripheral surface to provide an offset inner recessed surface with respect to the outer surface. The inner and outer circumferential planar surfaces are substantially in a parallel arc with respect to one another. These surfaces effect the flat plane of the concrete surface (not shown) during concrete finishing. The inner recessed surfaces and outer surface are offset with respect to one another, a structure which permits the rollers 21 and 22 to utilize free wheeling over the concrete surface as the rollers are vibrated. The substantially uniform planar surface provided by the peripheral outer surface when the rollers 21 and 22 engage the surface of the concrete improves the density and workability of the concrete thereby providing a smooth, filled, and sealed concrete surface. Also, such a structure permits the finishing of difficult concrete due to harsh mix designs, unpredictable delays, low slump specifications and wind exposure which causes abnormal surface drying.

The support frame 25 includes a cross beam 41, a pair of side beams 42 and 43 and a pair of support members including support members 44 and 45 associated with side member 42 and support members 46 and 47 associated with support member 43. The side members 42 and 43 extend in a parallel spaced relationship, normal to the forward panel 18 and spaced forwardly thereof. The cross member 41 extends parallel to the panel 18 and has its ends 25*a* and 25*b* connected to respective side members 42 and 43 near the midpoints thereof. The vibrating apparatus 23, which is mounted on the cross beam 41, comprises an eccentric motor driven hydraulically or electrically to impart vibrational movement to the support frame and the compacting rollers supported thereby.

Support member 44 depends from the forward end 42*a* of side member 42 and support member 45 depends from the rearward end 42*b* of side member 42. Each of the support members 44 and 45 includes a bearing (not shown) which receive the ends of the axle 34 of the compacting roller 21 for supporting the compacting roller with the roller's axis of rotation extending parallel to that of the augers 16 and finishing cylinders 15, and normal to the panel 18.

Similarly, side member 43 and support members 46 and 47 support compacting roller 22 with its axis of rotation extending parallel to that of the augers 16 and finishing cylinders 15, and normal to the panel 18. The compacting rollers 21 and 22 are supported on opposite sides of the augers 16 with their rotational axis spaced apart, for example, by a distance "w" of 25½". The compacting rollers 21 and 22 are mounted for free rotation within their bearings as the surfacing unit 12 is driven back and forth during usage. The dual augers move concrete forward on every pass, leaving the proper amount of concrete for ideal consolidation because they extend in front of the vibrating compacting rollers. The compacting rollers slightly depress and vibrate the surface of concrete with each pass of the surfacing unit.

The adjustable support assemblies or means 27 and 28 support the compactor assembly 10 relative to the roller finisher apparatus 12, as is known in the art. Isolators or cushion mounts of rubber or other resilient material 36 are interposed between the sub-frame 24 and the surfacing unit 12 to prevent the transmission of vibration from the sub-frame 24 to the surfacing unit 12 when the sub-frame is vibrated.

The adjustable sub-assembly means 27 and 28, permit vertical reciprocating movement up or down of the sub-frame 24 thereby raising or lowering the compacting rollers 21 and 22 relative to a concrete surface being finished. The movement of the compacting rollers 21 and 22 between a fully raised and a fully lowered position is effective to dispose them in upwardly withdrawn position relative to concrete to be vibrated, and to dispose them in the desired lowered position for vibrating the concrete, respectively. In this manner, the height of the sub-frame 24 and, therefore, of the compacting rollers 21, 22 relative to the roadway being surfaced is adjusted. The height of the compacting rollers is set to cause the compacting rollers to penetrate the surface of the concrete being worked to a depth of about ⅛ inch or less.

Referring now to FIGS. 5 and 6 and in accordance with the present invention, a compacting roller 21 has a planar outer peripheral surfaces 32 extending around the periphery of the cylinder or roller, with a plurality of recessed planar surfaces 33 being equally spaced about the periphery of the cylinder or roller. As pointed out above, each recess provides a planar surface 33 which is substantially in a parallel arc with respect to the planar peripheral outer surface to provide first and second compacting surfaces. The sides 38 of the recesses are sloped with respect to the outer surface 32 to provide a face for the compacting roller which is self-relieving, thereby preventing concrete from accumulating between and within the recesses in the compacting roller as the compacting roller 21 moves through and along the surface of the concrete being finished. The circumferential width of the recessed planar surfaces is between about one-half to one inch.

In use of the compactor assembly 10 with a concrete finishing machine, the concrete finishing machine is positioned over a roadway or the like, straddling the roadway to be surfaced and adjusted to provide the proper positioning of the surfacing unit 12 relative to the roadway. The manner in which such surfacing unit is adjusted is known in the art and is described for example in the referenced patents for specific units. Briefly, the finishing cylinders 15 are set at a height sufficient to establish to correct grade for the finished concrete surface, and the augers 16 are adjusted to provide the proper amount of concrete at the forward edge of the finishing cylinders to permit the finishing cylinders to provide optimum finishing. The concrete finishing machine is operated in the manner known in the art with the surfacing unit 12 being driven back and forth along a carriage track, reversing each time that it reaches the end position, as the concrete finishing machine is advanced forward along the roadway.

Referring again to FIGS. 1–3, the compacting rollers 21 and 22 are adjusted as to their vertical height relative to the surface being finished to provide the desired depth of penetration of the outer peripheral surface into the surface of the concrete being finished. By way of example, the height of the compacting rollers is set so that the compacting rollers penetrate the concrete surface to a depth of about ⅛ inch. This adjustment is made in the manner described above by the vertical adjusting apparatus 27 and 28 to raise or lower the compacting rollers 21 and 22 relative to the concrete surface.

After the sub-frame has been adjusted to locate the compactor rollers at the desired height, the compacting rollers rotate freely, moving along the surface of the concrete, as the surfacing unit 12 is driven back and forth. When the vibrating motor is activated, vibrations are transmitted through the sub-frame to the compacting rollers 21 and 22, such that the compacting rollers are vibrated to vibrate the concrete to the proper density and best quality finish during finishing by the finishing rollers 15. The compacting rollers engage the surface of the concrete, thereby permitting the roller to smooth, fill, and pave the surface of the concrete. This results in a better seal on the concrete and enables the finishing rollers to provide a smoother surface finish having significantly improved density and workability. Also, the vibrating action renders the compacting rollers self-cleaning. Moreover, the vibrating compactor provided by the present invention avoids the need to introduce water into the poured concrete prior to the finishing operation.

We claim:

1. For use in a concrete finishing machine for finishing concrete on a roadway and having a surfacing unit adapted for back and forth movement laterally of the roadway, the surfacing unit including finishing cylinder means and compacting means comprised of a sub-frame means, mounting means and vibrating means, said compacting means further including a plurality of compacting cylindrical rollers each having a periphery which engages the concrete to be finished, each roller structurally arranged to include peripheral outer surfaces extending about the periphery of the roller and peripheral recessed surfaces concentric to said outer surfaces and equally spaced therebetween about the periphery of the roller, with the peripheral outer and the peripheral recessed surfaces extending substantially the axial length of said compacting cylindrical rollers and with each of said peripheral outer and recessed surfaces having a circumferential width greater than the distance between said surfaces.

2. In the concrete finishing machine in accordance with claim 1, wherein said outer peripheral surface and said peripheral recessed surfaces provide offset surfaces concentric with respect to one another.

3. In the concrete finishing machine in accordance to claim 2, wherein said outer peripheral surfaces and said peripheral recessed surfaces are substantially positioned on said cylinder to provide a gear-like structure.

4. A concrete finishing machine according to claim 2, wherein the circumferential width of said recessed peripheral surfaces is between about one-half inch to one inch.

5. In a concrete finishing machine of the type embodying an elongated main frame adapted from movement longitudinally along a roadway or the like being surfaced, a surfacing unit for finishing a concrete surface, the surfacing unit being adapted for movement back and forth along the main frame laterally of the roadway and including first and second finishing cylinders each rotatably mounted to said main frame and extending in a parallel spaced relation, and first and second augers mounted for rotation with said first and second finishing cylinders, respectively, and extending in a parallel spaced relation, compacting means comprising:

a sub-frame;

first and second compacting rollers each having a periphery which engages the concrete to be finished;

vibrating means;

mounting means;

said sub-frame including means for rotatably mounting said compacting rollers in a parallel spaced relation adjacent to said auger, said compacting rollers each comprising an elongated cylinder having a plurality of outer peripheral surfaces extending about the periphery of said cylinder to provide a first compacting surface and a plurality of recessed peripheral surfaces positioned concentric to said outer surfaces in an equally spaced relation about the peripheral to provide a second compacting surface of said cylinder, with each of said first and second compacting surfaces extending substantially the axial length of said elongated cylinder and with each of said first and second compacting surfaces having a circumferential width greater than the distance between said surfaces;

said vibrating means coupled to said sub-frame for vibrating said sub-frame and said compacting rollers; and said mounting means including suspension means mounting said sub-frame to the main frame of the concrete finishing machine and isolating means interposed between said suspension means and said sub-frame for preventing transmission of vibrations from said sub-frame to the main frame as said sub-frame is vibrated.

6. A concrete finishing machine according to claim 5, wherein said first and second augers extend outwardly in cantilever fashion from the surfacing unit, with each auger having a proximal end and distal end, with said compacting rollers located on said surfacing unit near the proximal ends of the augers on opposite sides of the augers.

7. A concrete finishing machine according to claim 6, wherein the finishing rollers and the augers are aligned axially in pairs, with said augers extending between said compacting rollers.

8. A concrete finishing machine according to claim 5, wherein said outer peripheral surfaces and said recessed surfaces are substantially positioned on on said cylinder to provide a gear-like structure.

9. A concrete finishing machine according to claim 5, wherein the width of said recessed peripheral surfaces is between one-half inch to one inch.

* * * * *